US007240818B1

(12) United States Patent
Ho

(10) Patent No.: US 7,240,818 B1
(45) Date of Patent: Jul. 10, 2007

(54) ADJUSTABLE DEVICE FOR ADJUSTING SPACE FOR NAILS IN MAGAZINE OF NAIL GUN

(75) Inventor: Yu-Chuan Ho, Ta-Li (TW)

(73) Assignee: Apach Industrial Co., Ltd., Taichung Hsien (TW)

( * ) Notice: Subject to any disclaimer, the term of this patent is extended or adjusted under 35 U.S.C. 154(b) by 0 days.

(21) Appl. No.: 11/418,007

(22) Filed: May 5, 2006

(51) Int. Cl.
*B25C 1/04* (2006.01)

(52) U.S. Cl. ..... 227/109; 227/120

(58) Field of Classification Search ..... 227/109, 227/120, 136, 119, 127, 128
See application file for complete search history.

(56) References Cited

U.S. PATENT DOCUMENTS 4,389,012 A * 6/1983 Grikis et al. ..... 227/120
4,524,896 A * 6/1985 Morrell, Jr. ..... 227/126
4,784,306 A * 11/1988 Baum ..... 227/113
5,297,713 A * 3/1994 Perra et al. ..... 227/123
5,743,453 A * 4/1998 Chuang ..... 227/109
6,199,739 B1 * 3/2001 Mukoyama et al. ..... 227/8
6,431,428 B1 * 8/2002 Chen ..... 227/120
6,598,777 B2 * 7/2003 Osuga et al. ..... 227/136
6,641,020 B1 * 11/2003 Yao ..... 227/109
6,729,523 B1 * 5/2004 Wang et al. ..... 227/120
6,808,101 B2 * 10/2004 Laubach et al. ..... 227/109
6,913,180 B2 * 7/2005 Schuster ..... 227/109

* cited by examiner

*Primary Examiner*—Scott A. Smith
(74) *Attorney, Agent, or Firm*—Rosenberg, Klein & Lee

(57) ABSTRACT

A control device for a magazine of a nail gun includes a control knob located on an outside of the body and is connected to a control member extending into the groove in the magazine. A collar is threadedly connected to the control member and a bar which has two pivotable members pivotably connected to two ends thereof. The two pivotable members are pivotably connected to the body of the magazine so that when rotating the control knob, the bar is moved in the magazine so as to define the space for accommodating the nails of different sizes.

13 Claims, 7 Drawing Sheets

ADJUSTABLE DEVICE FOR ADJUSTING SPACE FOR NAILS IN MAGAZINE OF NAIL GUN

FIELD OF THE INVENTION

The present invention relates to an adjustable device for adjust the space for accommodating nails of nail guns simply by rotating a control member on the magazine.

BACKGROUND OF THE INVENTION

A conventional magazine 90 for receiving nails of nail guns is shown in FIG. 7 and generally includes an cover 91 and first rails 900 and second rails 901 defined in the magazine 90. A nail pusher 92 is slidable along the first or second rails 900, 901. A plurality of positioning portions 902 are defined in the magazine 90 so as to guide the separation plate 93 on the desired positioning portion 902 for accommodating nails of different sizes. The nails are then correctly pushed by the nail pusher toward the nose of the nail gun. When adjusting the position of the separation plate 3, the user has to remove the cover 91 from the magazine 90 and the separation plate 93 can be pulled out from the magazine 90 and then inserted in to the magazine 90 to set another space for receiving the nails of different size. There are many steps involved to remove the cover 91 and to re-install the separation plate 93. Therefore, the adjustment is a time-consuming task. Although some nail gun companies develop an adjustable device for adjusting the space for different nails of different sizes, the device is so complicated and is not satisfied in quality.

The present invention intends to provide an adjustable device which includes a control member on an outside of the magazine and the control member is connected with a bar which can be moved in the magazine to adjust the space into different sizes by rotating the control member.

SUMMARY OF THE INVENTION

The present invention relates to a nail gun which comprises a barrel with a handle connected thereto and a nose is connected to a front end of the barrel. A connection member is connected between the handle and a magazine which is connected to the nose. The magazine has a body and a groove is defined in the body which has an engaging slot so that a cover is engaged with the engaging slot. A rail is defined in the body and a nail pusher is movably engaged with the rail, and a coil spring is connected to the nail pusher. A separation member is located between the groove and the nail pusher. Two pivot portions are connected to two insides of the body and located close to the groove, and two first pins are connected to the pivot portions. An aperture is defined through a wall of the body and communicates with the groove. A control device is connected to the magazine and includes a control knob located on an outside of the body. A control member extends into the groove via the aperture. A collar is threadedly connected to the control member and a bar is connected to the collar. Two second pins extend through two ends of the bar and are pivotably connected to two pivotable members. By rotating the control knob, the separation member is moved in the magazine by the pivotable members so as to define spaces for accommodating nails of different sizes.

The primary object of the present invention is to provide an adjustable device on the magazine and the space in the magazine for nails can be easily adjusted by operating the adjustable device.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
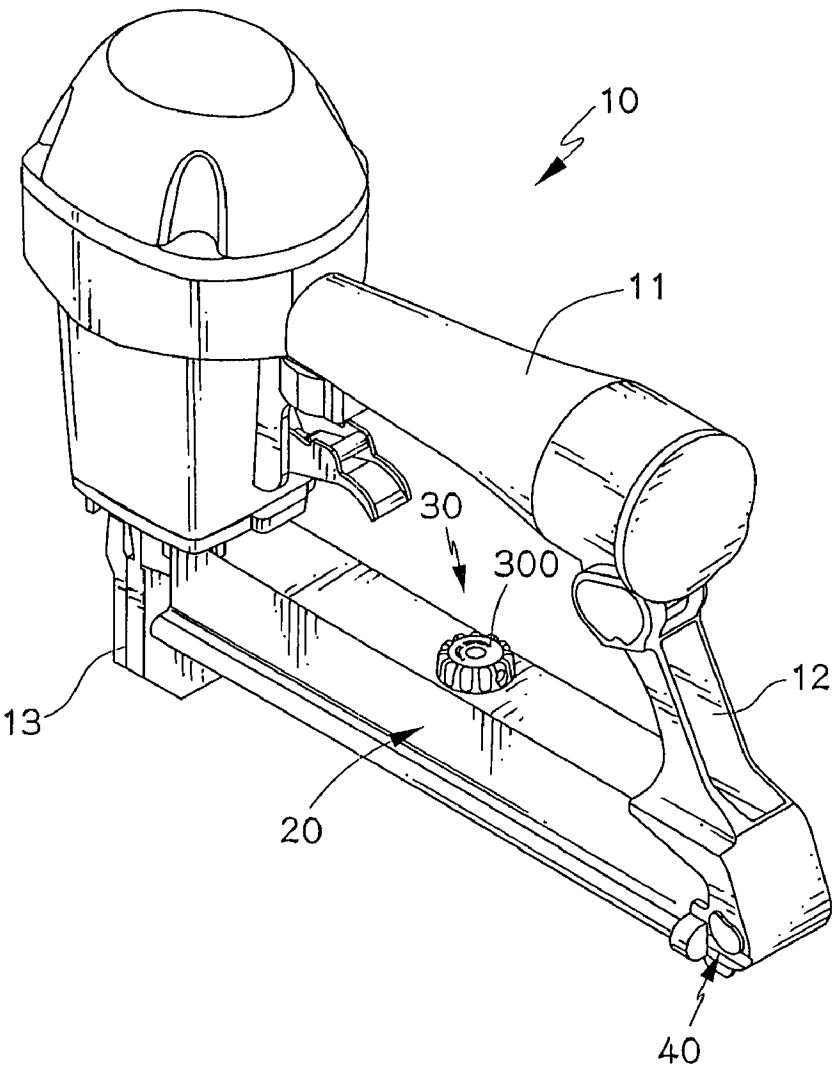
FIG. 1 is a perspective view to show the nail gun with the control device on the magazine of the nail gun present invention.
Figure 2:
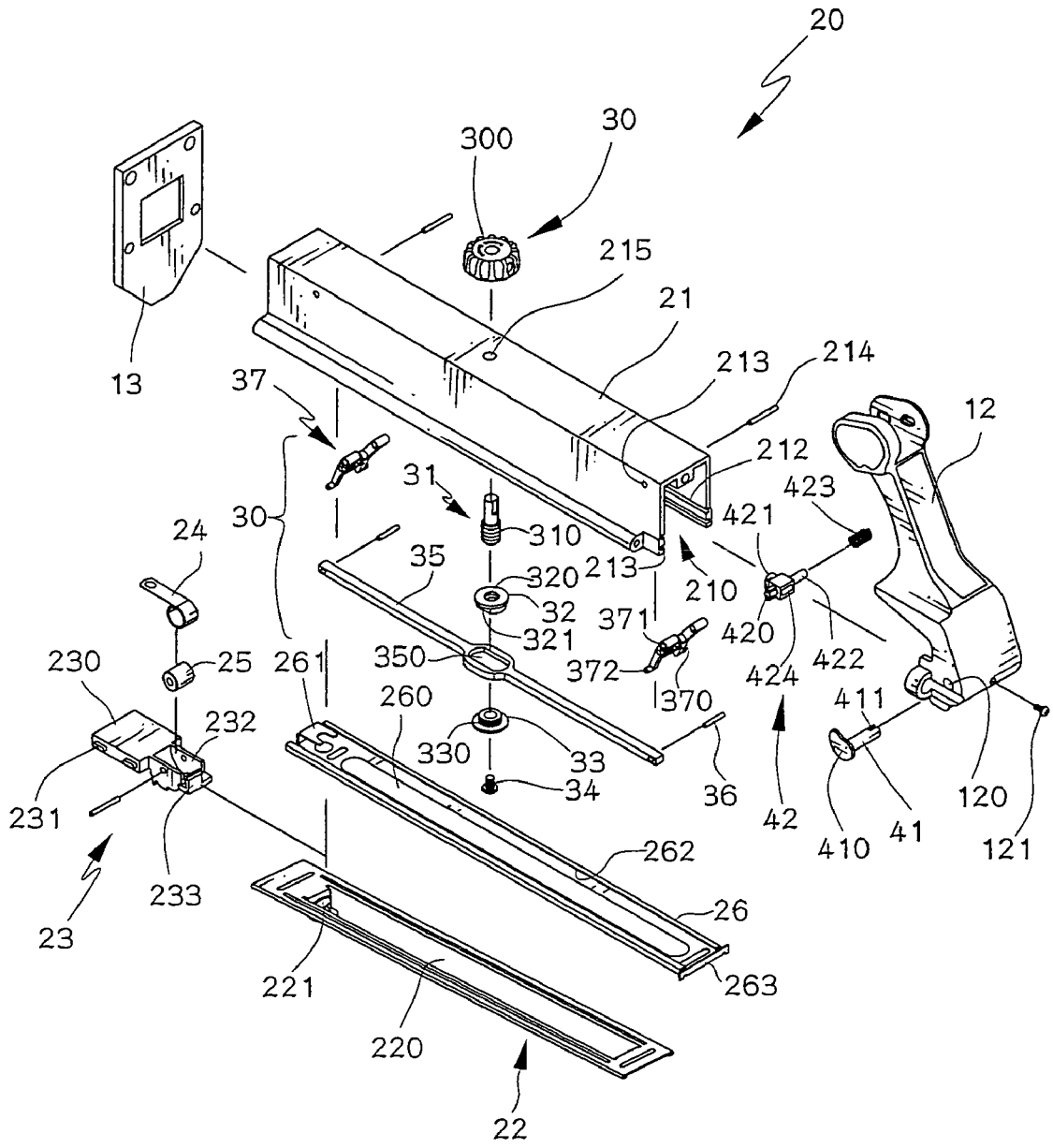
FIG. 2 is an exploded view to show the magazine and the adjustable device of the present invention.
Figure 3:
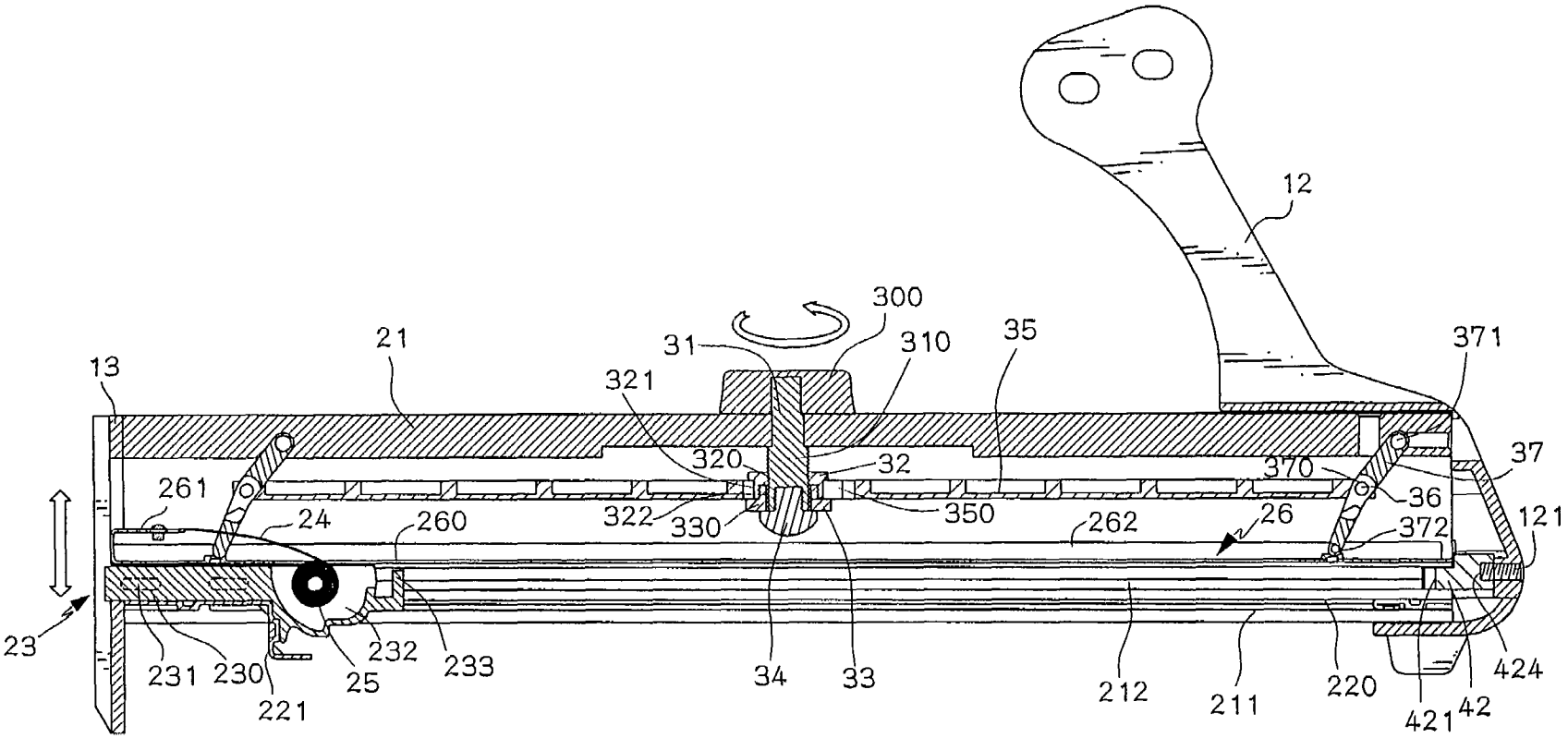
FIGS. 3 and 4 show that the separation member is moved to two different positions by rotating the control knob.

Referring to FIGS. 1 to 5, the nail gun 10 of the present invention comprises a barrel with a handle 11 connected thereto and a nose 13 is connected to a front end of the barrel. A connection member 12 is connected between the handle 11 and a magazine 20 which is connected to the nose 13 so that nails are ejected from the nose 13. The magazine 20 having a U-shaped body 21 and a groove 210 is defined in the body 21. An engaging slot 211 is defined in a side of the body 21 so that a cover 22 is engaged with the engaging slot 211 of the body 21 to seal the groove 210. A rail 212 is defined in the body 21 and a nail pusher 23 is movably engaged with the rail 212. The cover 22 has a long slot 220 and a stop 221 is located at an end of the cover 22 so as to stop the nail pusher 23. The nail pusher 23 includes a pushing end 230 which faces the nose 13 and two side wings 231 are located on two sides of the pushing end 230 so as to be slid into the rail in the magazine 20. A coil spring 24 is mounted on a mandrel 25 and is connected to the nail pusher 23 so that the nail pusher 23 tends to push the nails in the magazine 20. A recess 232 is defined in a central portion of the nail pusher 23 and the coil spring 24 and the mandrel 25 are received in the recess 232.

A separation member 26 is located between the groove 210 and the nail pusher 23 and is used to define spaces for the nails of different sizes. A slot 260 is defined through the separation member 26 and an L-shaped tongue 261 is formed on an end of the separation member 26. The L-shaped tongue 261 includes a horizontal portion and vertical portion, and the coil spring 24 is connected to the horizontal portion by screw and nut. An end piece 263 is connected to an end of the separation member 26 and is exposed outside of the magazine 20. The end piece 263 is movably on the end of the body 21 of the magazine 20 and ensures that the separation member 26 can be moved relative to the body 21 of the magazine 20.

Two pivot portions 213 are connected to two insides of the body 21 and located close to the groove 210, and two first pins 214 are connected to the pivot portions 213. An aperture 215 is defined through a wall of the body 21 and communicates with the groove 210.

A control device 30 includes a control knob 300 located on an outside of the body 21. The control knob 300 includes indexes which displays directions of rotations of the control knob 300 for different sizes of nails. A control member 31 is connected with the control knob 300 and extends into the groove 210 via the aperture 215. The control member 31 includes a threaded section 310 which is threadedly connected with a threaded hole 320 of a collar 32 while the threaded hole 320 is larger than the threaded section 310 so that the threaded section 310 simply extends through the threaded hole 320. Two flat surfaces 321 are defined in an outer periphery of the collar 32 and engaged with an elongate hole 350 defined in a bar 35 so that the collar 32 is connected to the bar 35. A connection disk 33 has a threaded neck 330 which is threadedly connected to a wider portion of the threaded hole 320 in the collar 32 and a bolt 34 extends through the connection disk 33 and connected to a threaded recess defined in the distal end of the threaded section 310. Two second pins 36 extend through two ends of the bar 35 and two pivotable members 37 are pivotably connected to the second pins 36. Two guide portions 262 are formed on two sides of the separation member 26 so that the pivotal ends 372 of the pivotable members 37 are movably engaged with the guide portions 262. The two, first pins 214 pivotably extend through two respective connection portions 371 on the two pivotable members 37.

A positioning device 40 is located at the connection member 12 and close to the nail pusher 23. The positioning device 40 includes a push pin 41 which includes an end inserted into a through hole 120 defined in the connection member 12 and engaged with an action member 42, wherein the action member 42 has a hook 421 and the nail pusher 23 has an engaging part 233 which is hooked with the hook 421. The push pin 41 has a head 410 on an end thereof and the head 410 is located on side of the connection member 12, and the other end of the push pin 41 has a notch 411 so as to be engaged with a rod 420 on an end of the action member 42. A spring 423 has one end mounted to an insertion 422 on the action member 42 so that the action member 42 is pushed toward the nail pusher 23. The other end of the spring 423 is inserted into the through hole 120. The action member 42 further includes a dent 424 in which a protrusion 121 on the connection member 12 is inserted.

Figure 4:
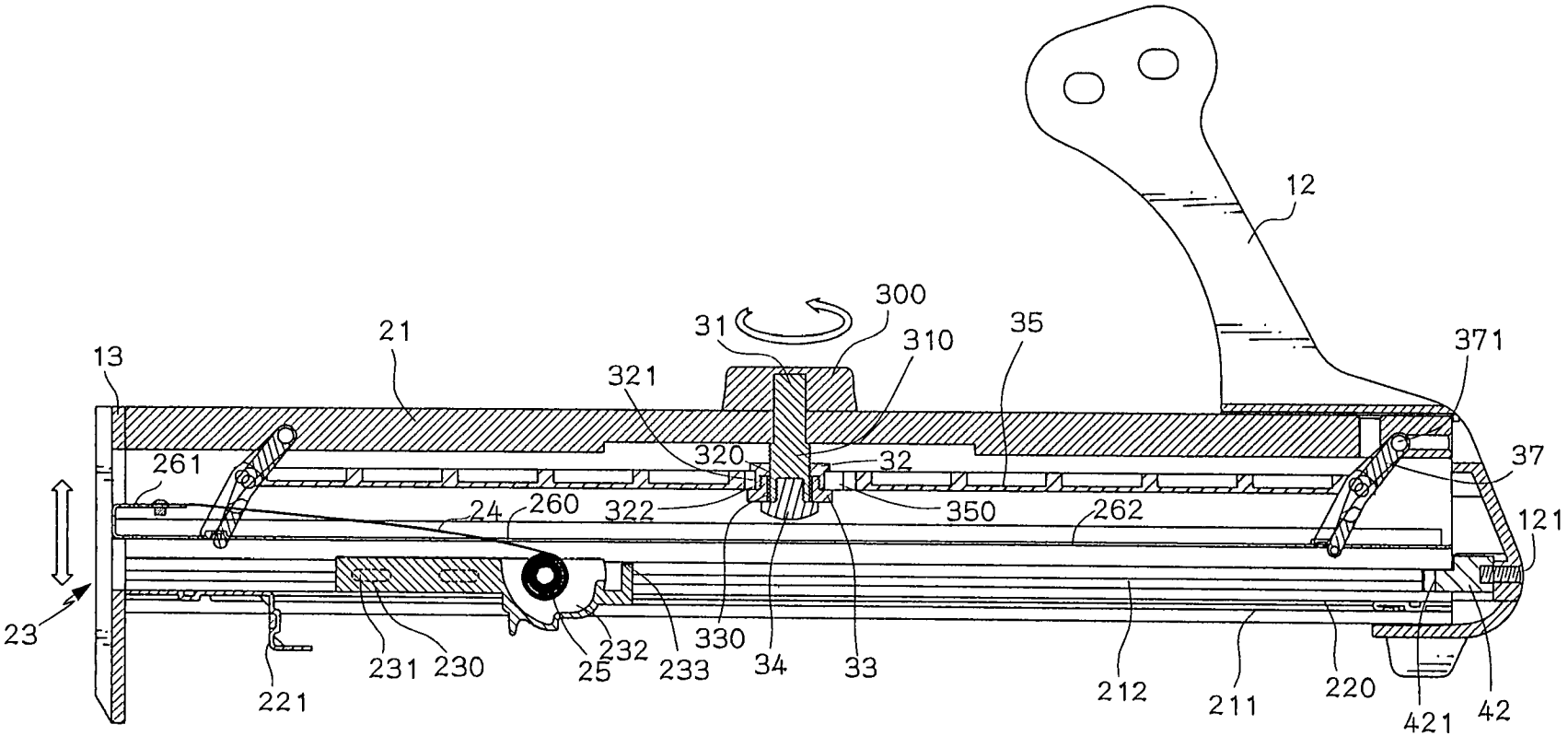
Figure 5:
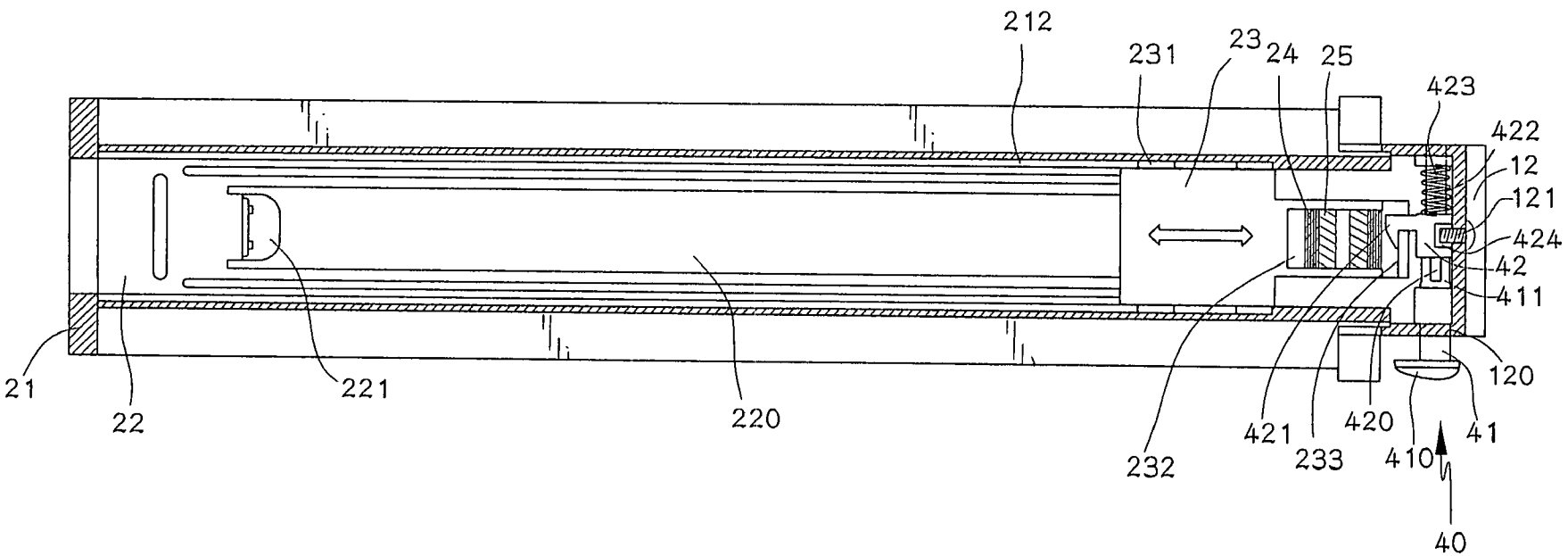
FIG. 5 shows the positioning device of the present invention.

When rotating the control knob 300, as shown in FIG. 4, the control member 31 is rotated and because the collar 32 and the bar 35 do not have any relative movement, so that the collar 32 together with the bar 35 are moved along the control member 31. The movement of the bar 35 pivots the two pivotable members 37 so that the position of the separation member 26 connected to the pivotal ends 372 is adjusted. The separation member 26 is supported by multiple points by the pivotal ends 372 of the pivotable members 37 so that it can be moved in stable condition.

When the space for the nails is defined by operation of the control device 30, the user pushes the push pin 41 to remove the action member 42 from the nail pusher 23. When the nail pusher 23 is pushed to the end of the magazine 20, the engaging part 233 on the mail pusher 23 pushes the hook 421 of the action member 42 to compress the spring 423 till the engaging part 233 enters into the range of the hook 421. The action member 42 is pushed back by the spring 423 to ensure that the hook 421 is hooked with the engaging part 233, so that the nail pusher 23 is maintained at the position.

The space for the nails can be easily and quickly adjusted by rotating the control knob 300 and the separation member 26 is moved in the magazine 20 stably by the support of the multiple support points of the pivotable members 37 so that the adjustment is completed with high efficiency. By the positioning device 40, the nail pusher 23 can be positioned close to the connection member 12 so that it is safe for the user to load the nails in the magazine 20. The nail pusher 23 is released simply by pressing the push pin 41.

Figure 6:
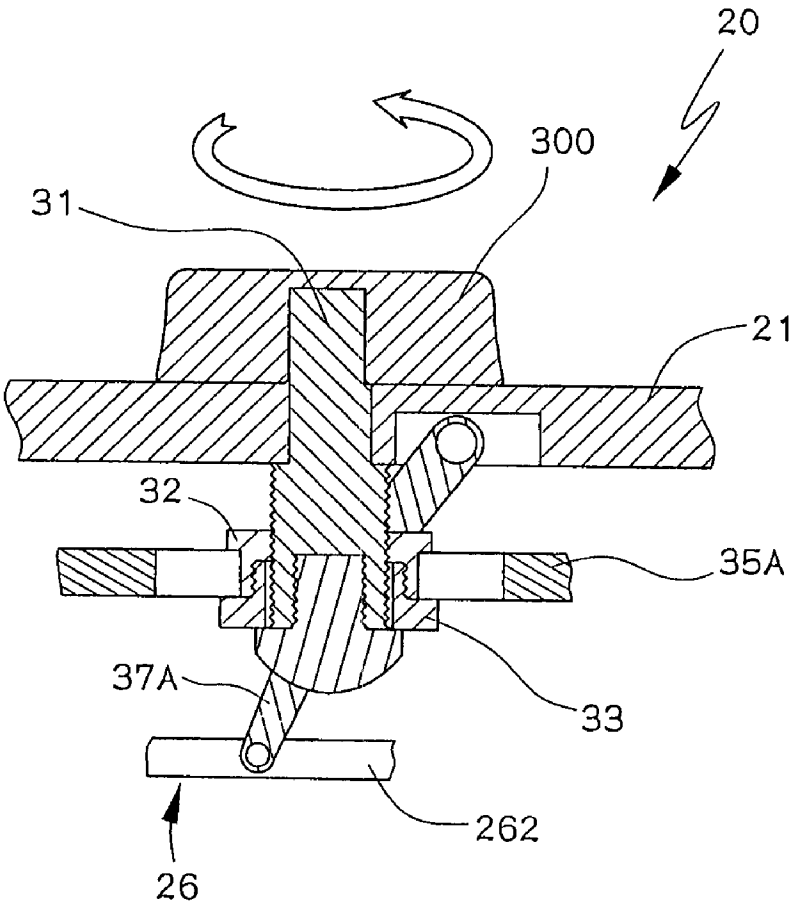
FIG. 6 shows another embodiment of the control device of the present invention.
Figure 7:
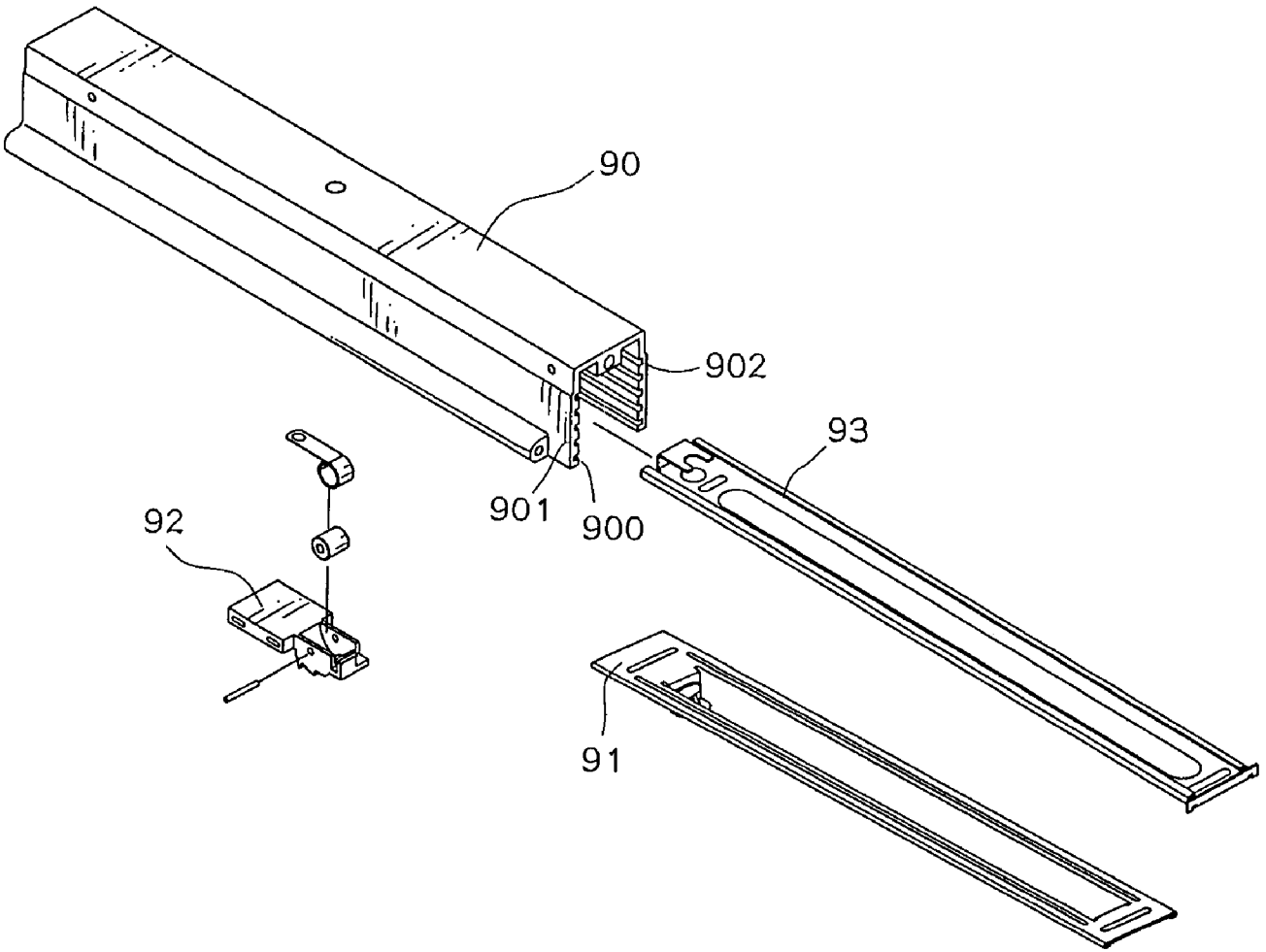
FIG. 7 PRIOR ART
FIG. 7 is an exploded view to show a conventional magazine for nail gun.

FIG. 6 shows that the bar 5 and the pivotable members can be made as a one piece. Two pivotable members 37A are pivotably connected to two sides of the bar 35A, and one end of each pivotable members 37 is pivotably connected to the body 21 of the magazine 20, the other end of each pivotable member 37 is slidably connected to two sides of the separation member 26.

While we have shown and described the embodiment in accordance with the present invention, it should be clear to those skilled in the art that further embodiments may be made without departing from the scope of the present invention.

What is claimed is:

1. A nail gun comprising:

a barrel with a handle connected thereto and a nose connected to a front end of the barrel, a connection member connected between the handle and a magazine which is connected to the nose, the magazine having a body and a groove defined in the body, an engaging slot defined in a side of the body and a rail defined in the body;

a cover engaged with the engaging slot of the body;

a nail pusher movably engaged with the rail and a coil spring connected to the nail pusher;

a separation member located between the groove and the nail pusher;

two pivot portions connected to two insides of the body and located close to the groove and two first pins connected to the pivot portions, an aperture defined through a wall of the body and communicating with the groove, and a control device including a control knob located on an outside of the body, a control member extending into the groove, a collar threadedly connected to the control member, a bar connected to the collar, and two second pins extending through two ends of the bar and pivotably connected to two pivotable members.

2. The device as claimed in claim 1, wherein the control knob includes indexes which are adapted to display sizes of nails.

3. The device as claimed in claim 1, wherein the control member includes a threaded section and the collar includes a threaded hole with which the threaded section is engaged, two flat surfaces are defined in an outer periphery of the collar and the bar includes an elongate hole with which the two flat surfaces are engaged, the collar is connected with a connection disk and a bolt extends through the connection disk, the collar and is connected to an end of the control member.

4. The device as claimed in claim 1, wherein the two pivotable members are pivotably connected to the two ends of the bar and each pivotable member includes a connection portion which is pivotably connected to the body, the two pivotable members each have a pivotal end pivotably connected to the separation member.

5. A nail gun comprising:

a barrel with a handle connected thereto and a nose connected to a front end of the barrel, a connection member connected between the handle and a magazine which is connected to the nose, the magazine having a body and a control device connected to the body, a groove defined in the body, an engaging slot defined in a side of the body and a rail defined in the body;

a cover engaged with the engaging slot of the body;

a nail pusher movably engaged with the rail and a coil spring connected to the nail pusher;

a separation member located between the groove and the nail pusher;

two pivot portions connected to two insides of the body and located close to the groove and two first pins connected to the pivot portions, an aperture defined through a wall of the body and communicating with the groove, and a positioning device located at the connection member and close to the nail pusher, the positioning device including a push pin which includes an end inserted into the connection member and engaged with an action member, the action member having a hook and the nail pusher has an engaging part which is hooked with the hook, a spring connected to the action member so that the action member is pushed toward the nail pusher.

6. The device as claimed in claim 5, wherein the connection member includes a though hole in which the end of the push pin is inserted, the push pin has a head on an end thereof and the end of the push pin has a notch so as to be engaged with the action member.

7. The device as claimed in claim 6, wherein the action member includes a rod on an end thereof so as to be connected with the push pin, the action member includes an insertion and the spring has one end mounted on the insertion and the other end of the spring is inserted into the through hole, the action member includes a dent in which a protrusion on the connection member is inserted.

8. A nail gun comprising:

a barrel with a handle connected thereto and a nose connected to a front end of the barrel, a connection member connected between the handle and a magazine which is connected to the nose, the magazine having a body and a groove defined in the body, an engaging slot defined in a side of the body and a rail defined in the body;

a cover engaged with the engaging slot of the body;

a nail pusher movably engaged with the rail and a coil spring connected to the nail pusher;

a separation member located between the groove and the nail pusher;

two pivot portions connected to two insides of the body and located close to the groove and two first pins connected to the pivot portions, an aperture defined through a wall of the body and communicating with the groove;

a control device including a control knob located on an outside of the body, a control member extending into the groove, a collar threadedly connected to the control member, a bar connected to the collar, and two second pins extending through two ends of the bar and pivotably connected to two pivotable members, and a positioning device located at the connection member and close to the nail pusher, the positioning device including a push pin which includes an end inserted into the connection member and engaged with an action member, the action member having a hook and the nail pusher has an engaging part which is hooked with the hook, a spring connected to the action member so that the action member is pushed toward the nail pusher.

9. The device as claimed in claim 8, wherein the control knob includes indexes which are adapted to display sizes of nails.

10. The device as claimed in claim 8, wherein the control member includes a threaded section and the collar includes a threaded hole with which the threaded section is engaged, two flat surfaces are defined in an outer periphery of the collar and the bar includes an elongate hole with which the two flat surfaces are engaged, the collar is connected with a connection disk and a bolt extends through the connection disk, the collar and is connected to an end of the control member.

11. The device as claimed in claim 8, wherein the two pivotable members are pivotably connected to the two ends of the bar and each pivotable member includes a connection portion which is pivotably connected to the body, the two pivotable members each have a pivotal end pivotably connected to the separation member.

12. The device as claimed in claim 8, wherein the connection member includes a though hole in which the end of the push pin is inserted, the push pin has a head on an end thereof and the end of the push pin has a notch so as to be engaged with the action member.

13. The device as claimed in claim 12, wherein the action member includes a rod on an end thereof so as to be connected with the push pin, the action member includes an insertion and the spring has one end mounted on the insertion and the other end of the spring is inserted into the through hole, the action member includes a dent in which a protrusion on the connection member is inserted.

* * * * *